United States Patent [19]

Warren

[11] 4,023,349

[45] May 17, 1977

[54] VALVE ARRANGEMENTS FOR RECIPROCATING PISTON MACHINES

[76] Inventor: Glenn B. Warren, 1361 Myron St., Schenectady, N.Y. 12309

[22] Filed: Nov. 17, 1975

[21] Appl. No.: 632,314

[52] U.S. Cl. ..... 60/39.6; 123/41.17; 123/41.85; 123/41.77; 123/188 GC

[51] Int. Cl.[2] ..... F02G 3/02

[58] Field of Search ..... 60/39.6, 39.61, 39.62, 60/39.63; 123/90.24, 41.17, 41.85, 41.77, 188 GC, 188 A, 188 AF

[56] References Cited

UNITED STATES PATENTS

| | | | |
|---|---|---|---|
| 2,459,447 | 1/1949 | Milliken | 60/39.63 |
| 2,977,759 | 4/1961 | Milliken | 60/39.63 |
| 3,088,276 | 5/1963 | Hudson | 60/39.6 |
| 3,577,729 | 5/1971 | Warren | 60/39.63 |
| 3,826,081 | 7/1974 | Van Avermaete | 60/39.63 |
| 3,877,220 | 4/1975 | Girodin | 60/39.63 |

*Primary Examiner*—Clarence R. Gordon
*Attorney, Agent, or Firm*—Joseph V. Claeys

[57] ABSTRACT

A pneumatically actuated valve for controlling the flow of fluid from an inlet passage to the cylinder of a reciprocating piston machine wherein the valve is opened by the fluid pressure in the cylinder as the piston approaches top dead center and closed by fluid pressure from the cylinder supplied to the top of a plunger connected to the end of the valve stem when the piston is preselected distance below top dead center.

14 Claims, 1 Drawing Figure

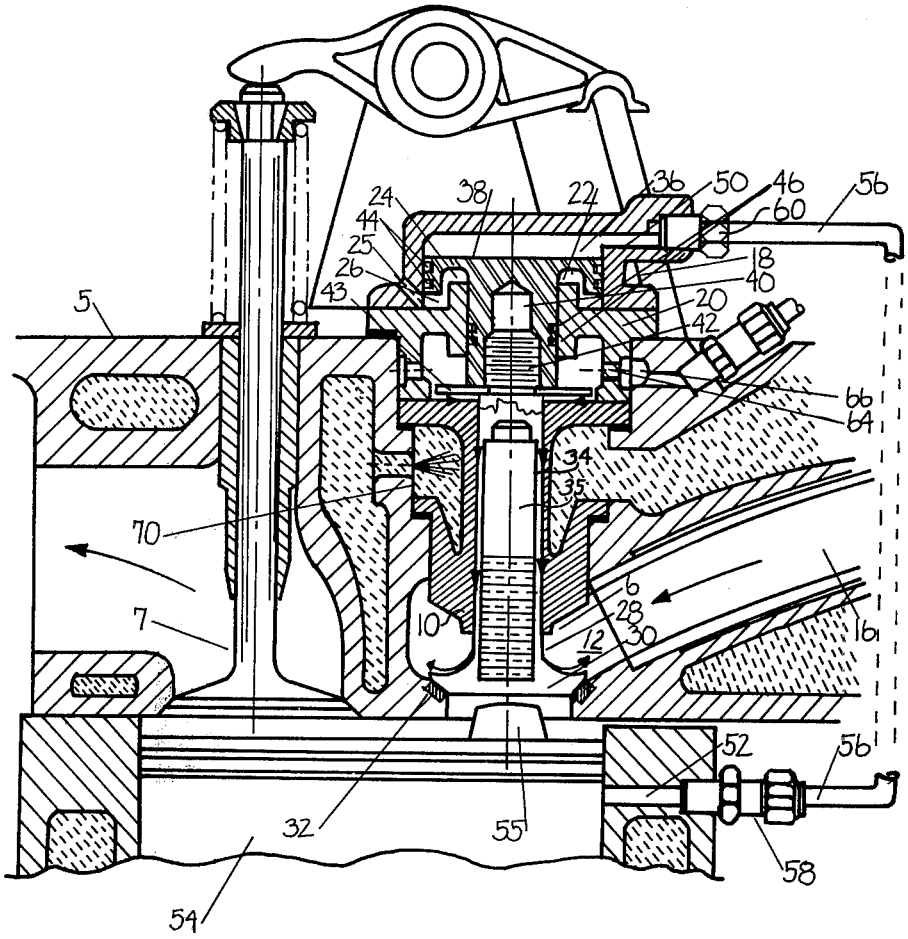
5
24
44
25
26
43
38
22
36
50
46
60
56
18
40
20
42
66
64
34
35
70
7
6
28
30
10
12
16
52
56
32
55
58
54

VALVE ARRANGEMENTS FOR RECIPROCATING PISTON MACHINES

BACKGROUND OF THE INVENTION

This invention relates to valve arrangements for controlling the flow of fluids, particularly high temperature fluids of reciprocating piston engines, which arrangements obviate the need for a cam and a mechanical spring.

While this invention has a wide range of applications, it is especially useful in controlling the flow of high temperature fluids in reciprocating engines employing external combustion systems of the type disclosed in Warren's U.S. Pat. No. 3,577,729; consequently, it will be described in detail in connection with that engine.

Air pollution has become a major problem in the United States and other highly industrialized countries of the world. There is ample evidence that major contributors to this pollution are automobiles employing the conventional internal combustion, reciprocating piston engines.

The new and improved engine of Warren's U.S. Pat. No. 3,577,729, while retaining many of the basic structural features of the conventional mass produced, internal combustion engine, provides greater fuel economy and exhibits substantially lower level of basic pollutants (CO, HC, $NO_x$) because it employs a stable, controlled, external combustion system. The analysis and calculations show that the most restrictive federal emission requirements are fully met even by a high performance new engine and even in a vehicle weighing up to 5000 pounds.

The use of an external combustion system subjects at least some of the valve means to operating conditions different from those of the conventional engine so that some of such conventional valve arrangements are not entirely satisfactory for use with an engine such as that described in Warren's U.S. Pat. No. 3,577,729. For example, the typical cam-spring type valve arrangement may not be entirely satisfactory for controlling the flow of the high temperature combustion products from the external combustion system into the engine cylinders for expansion therein to drive the pistons in well known manner.

The prior art valve arrangements of the conventional internal combustion engines are typically of the type which are opened by a cam against the resistance of a valve closing spring. In order to achieve the required rapid closing of such valve to control efficiently the flow of the high temperature gas from the external combustion system to the engine cylinder of the type shown in Warren's U.S. Pat. No. 3,577,729, it may be necessary to use a custom made, exceedingly strong, valve spring. The use of such a strong spring is undesirable not only because the spring itself is more costly, but also because it results in high inertias and in great stress on the entire valve train. The combination of these factors results in increased valve cost, as well as overall increased costs and complexity of the engine.

It is an object of this invention, therefore, to provide a valve arrangement for controlling the flow of high temperature fluids which overcomes one or more of the foregoing described difficulties.

It is another object of the invention to provide a valve arrangement for controlling the flow of fluids which is simple, reliable and low in cost.

It is still aother object of the invention to provide a fast acting, low cost, reliable valve arrangement for controlling the flow of fluids which obviates the need for either a cam or a valve spring.

It is a further object of the invention to provide a fast acting valve arrangement for an engine which is simple, reliable and of low cost and allows for simplification of the engine design and consequent reduction in engine production costs.

It is a still further object of the invention to provide a fast acting pneumatically actuated valve arrangement for controlling the flow of high temperature fluids which includes means to dampen or cushion the force of impact as the valve is closed.

SUMMARY OF THE INVENTION

In accordance with one aspect of the invention, there is provided a valve arrangement for controlling the flow of fluid from an inlet passage to an engine working cylinder having a piston reciprocally positioned therein. A discharge valve means is closed in the conventional manner by a valve closing spring a proper number of degrees before the piston reaches the top dead center position and an inlet valve having a head and a stem extending therefrom is actuated to its open position by the pressure of the fluid compressed in the working cylinder as the piston approaches top dead center. Actuation of the valve to the closed position is effected at the required time by communicating the pressure of the fluid in the working cylinder to an enclosed space above a plunger which is secured to the end of the valve stem and is slidingly positioned in a chamber adjacent to the cylinder. The fluid pressure is applied to the plunger from a port in the wall of the working cylinder, which port is located at a preselected point below the top dead center position of the piston to provide for the rapid closing of the valve at the desired "cut-off" point of the piston stroke in accordance wth the operating requirements of the engine.

BRIEF DESCRIPTION OF THE DRAWING

The sole FIGURE shows an elevational sectional view of the pressure actuated valve assembly in accordance with the present invention adapted for operation in a reciprocating piston engine having an external combustion chamber; only the parts of the engine which are pertinent in describing the working oof the valve are illustrated.

DETAILED DESCRIPTION

The sole FIGURE of the drawing illustrates one embodiment of the invention incorporated in an external combustor, reciprocating piston engine of the type described in Warren U.S. Pat. No. 3,577,729. The valve arrangement of the invention is employed to control the flow of the high temperature fluid from the combustor to the expansion cylinders of a reciprocating piston engine. An important feature of the valve arrangement of the present invention is that movement of the valve head to open the inlet passage is away from the engine piston, whereas in the usual internal combustion engine arrangements the valve head moves toward the piston. This is important since in an engine such as that described in Warren U.S. Pat. No. 3,577,729, the cylinder head to piston clearance remains small for reasons of efficiency so that failure in the cam closing of the discharge valve or opening of the inlet valve could result in very high pressure above the piston with possible resulting engine damage. Such a condition is not possible with the valve arrangement of this invention snce any such pressure build-up tends to open the valve. As illustrated in the drawing, an engine cylinder head 5 is provided with suitable inlet and discharge valve arrangements, shown generally by the reference numerals 6 and 7 respectively, for controlling the flow of fluid into and out of the expansion cylinder of a reciprocating piston engine. The inlet valve arrangement 6 is constructed in accordance with the present invention. The discharge valve arrangement may be of any suitable type and is illustrated as being of the conventional type which is opened by a cam against the resistance of a valve closing spring.

As shown in the drawing, inlet valve arrangement 6 includes a valve guide 10 extending into an inlet passage 12 which in turn communicates at one end with the expansion cylinder 14 of the engine and at the other end with an outlet manifold passage 16 of an external combustion system (not shown). Valve arrangement 6 also includes a chamber 18 having a cylindrical bore adjacent the outer end of the valve guide 10. A wall 20 having a central bore 22 divides the chamber 18 into an upper portion 24 and a lower portion 26. The upper portion 24 has a hole 25 which communicates wth the atmosphere.

A valve 28 has a head 30 arranged to mate with a valve seat 32 of inlet passage 12. Valve 28 also has a stem 34 extending from the head 30 and through valve guide 10 into the chamber 18. Preferably, for high temperature applications valve 28 may be of the cooled type, wherein a suitable quantity of a material, such as Sodium, is contained in a hollow region of the valve stem.

Valve 28 is actuated between open and closed positions with respect to the valve seat 32 to control the flow of fluid from the outlet manifold passage 16 of the external combustion system to the expansion cylinder 14 of the engine.

In accordance with this invention, means are provided to pneumatically actuate valve 28 between its open and closed positions in a simple and reliable manner and in accordance with the operating requirements of the engine. To this end, a plunger 36 is affixed to the end of valve stem 34. Plunger 36 has a cylindrical head portion 38 slidingly disposed in the upper portion 24 of chamber 18 and a smaller diameter central portion 40 slidingly disposed in the central bore 22 of the dividing wall 20. Conveniently, the central portion 40 may be provided with a suitably threaded bore 42 for connection with the correspondingly threaded end of the valve stem 34. An annular plate 43 rests on a shoulder of valve stem 34 and is secured thereto between such shoulder and the bottom of the central portion 40 of plunger 36. Annular plate 43 should be located at a sufficient distance above the bottom of the lower portion 26 of chamber 18 to allow full closing of the valve 28. Annular plate 43 has a diameter slightly smaller than the inside diameter of the lower portion 26 of chamber 18 so that a small annular passage is defined therebetween. Suitable seal rings 44 are provided on head portion 38 and similar seal rings 46 are provided on the central portion 40.

An opening 50 in the upper portion 24 of chamber 18 communicates with a similar opening 52 in the wall of the expansion cylinder 14. Opening 52 in the wall of expansion cylinder 14 is located at a preselected point below the top dead center position of a piston 54. Communication between the openings 50 and 52 is shown as being provided by passage 56 with suitable fittings 58 and 60. It will be understood that any other suitable means may be employed to provide the required communication between the openings 50 and 52.

The lower portion 26 of chamber 18 is provided with an annular channel 64 which communicates with an opening 66 in the chamber wall. The opening 66 is adapted to be connected with a source of compressed air, such as a compression cylinder which supplies combustion air to the external combustion system as described in Warren's U.S. Pat. No. 3,577,729.

Engine cylinder head 5 may include suitable internal passages adapted to be supplied with liquid coolant in any conventional manner. To provide for more effective cooling of the valve, a wall 70 having a plurality of apertures therein is provided in the coolant passage adjacent the valve guide 10. The liquid coolant is forced through the apertures in the wall 70 to produce a more active circulation of liquid coolant in the region adjacent the valve guide as well as providing some "scrubbing" of the outer valve guide surface for improved cooling effect.

The operation of the inlet valve arrangement of this invention may best be explained by following in sequence the operational steps beginning at the time when the valve 28 is in the open position allowing the combustion gases from the combustion chamber (not shown) to flow through the manifold passage 16 into the expansion cylinder 4.

As the piston 54 is forced downward by the entering combustion gases, it exposes the opening 52 in the side of the power cylinder 14. The combustion gases flow into the opening 52 then through the passage 56 (shown partially in phantom) into the upper portion 24 of the valve chamber 18. There the combustion gases exert pressure on the head portion 38 of the plunger 36. The total surface area of the head portion 38 is selected to assure that the force on the head portion 38 together with the force exerted by the combustion gases on the top of the valve head 30 exceeds the sum of the force exerted by the combustion gases on the bottom of the valve head 30 and the associated frictional forces. The resulting force differential acting on head portion 38 of plunger 36 forces the valve 28 downward until the head 30 rests against the valve seat 32, thus closing inlet passage 12.

The impact of the contact between the valve head 30 and the valve seat 32 is cushioned by the resistance of the air trapped in the lower portion 26 of chamber 18 underneath the annular plate 43 and by the resistance of the air escaping through the small hole 25. The amount of damping of the impact can be regulated by suitably selecting the size of the annular passage between the annular plate 43 and the side walls of the lower portion 26 and/or the size of the hole 25.

During the exhaust stroke, as the piston 54 approaches top dead center with the discharge valve 7 open, the pressure in upper portion 24 above the head 38 of plunger 36 is reduced to the cylinder discharge pressure. At the proper number of degrees before piston 54 reaches top dead center, opening 52 in the wall of cylinder 14 is closed and discharge valve means 7 is also caused to be closed. Accordingly, the force exerted by the gases being compressed as the piston 54 continues its upward movement acting on the bottom of valve head 30 is greater than that exerted on the head 38 of plunger 36 thereby causing the valve head 30 to be moved out of contact with valve seat 32 and opening the inlet passage 12. Further, just as soon as the valve head 30 is partially open the pressure on the bottom of valve head 30 quickly equalizes with that in passages 12 and 16 due to the small clearance volume above piston 54 at the top dead center position. The unbalanced pressure on the bottom of the stem area compared to the near atmospheric pressure on the top of head 38 of plunger 36 will keep valve 29 opening until it reaches the end of its travel. Accordingly, since the only area on which the pressure acts to accelerate the valve upward (open) is the cross section area of the stem 34, the area of stem 34 must be made large enough to provide for the proper upward acceleration of the valve for the design speed of the engine.

The impact of moving the valve 28 into its open position is cushioned by the resistance of the gas contained in the upper portion 24 above the head 38 of plunger 36 and the gas in the lower portion 26 above the annular plate 43. A projecton 55 may be provided on the top of the piston 54 in the location corresponding to the location of the valve head 30 to urge it upward to assure positive opening of the valve under very low load conditions or if the valve tended to stick. Since at the moment of impact of projection 55 with valve head 30, piston 54 would be at about its top dead center position, and therefore moving extremely slowly, the impact between the projection 55 and the head 30 causes negligible amount of noise and wear. Furthermore, such impact occurs only under most extreme operating conditions.

To assist in cooling of the valve, cool compressed air from a source such as the compression cylinder (not shown) is forced past the bore 66 and annular channel 64 into the lower portion 26 of chamber 18. From there the air is directed downward through the space between the valve guide 10 and the valve stem 34. The cool compressed air is at a higher pressure than that of the combustion gases; consequently, it not only cools the valve stem as it flows downward but it also keeps the hot combustion gases away from the head 30 and prevents their entry into the space between the valve stem 34 and the valve guide 10. Further cooling of the valve can be provided in conventional manner by use of a cooled valve wherein, the valve stem 34 would be provided with a suitable hollow space 35 which would be filled preferably 50 percent by volume with a suitable material, such as Sodium.

In accordance with another feature of the invention when employed with a liquid-cooled engine, the valve guide 10 may also be cooled by circulating cooling fluid in the coolant passages and by forcing it under pressure through small apertures in the jacket wall 70 into the region adjacent the valve guide.

While only a preferred embodiment of the invention has been shown and described by way of illustration, many changes and modifications will occur to those skilled in the art. It is, therefore, to be understood that the appended claims are intended to cover all such modifications and changes as fall within the true spirit and scope of the invention.

What is claimed as new and desired to be secured by Letters Patent of the United States is:

1. The combination with a reciprocating piston machine of valve means for controlling the flow of fluid from an inlet passage to a cylinder having a working piston reciprocally disposed therein, the combination comprising:

a. chamber having a cylindrical bore adjacent said cylinder;

b. a valve having a head adapted to contact a valve seat associated with said inlet passage adjacent said cylinder and a stem extending from said valve head toward said chamber, said valve head being adapted to be moved away from said valve seat to admit fluid into said cylinder by the pressure applied to said valve stem and head as said working piston approaches top dead center;

c. a plunger carried by said valve stem and slidingly disposed within the cylindrical bore of said chamber; and d. means effecting the closing of said valve at the desired time, said means including porting means controlled by the position of said working piston for communicating the pressure of the fluid in said cylinder to the chamber space above said plunger at working piston positions lower than a predetermined point below top dead center, said pressure acting on the area of said plunger and providing the force to move said valve to its closed position.

2. The combination recited in claim 1 including damping means carried by said valve stem and operative within said chamber to damp the closing impact of said valve.

3. The combination recited in claim 2 wherein said damping means comprises an annular plate defining an annular passage with the inside walls of said cylindrical bore of said chamber and a space between said plate and the bottom of said chamber.

4. The combination recited in claim 1 including means for forcing cooling fluid downward along the valve stem.

5. In a reciprocating engine of the type wherein air and fuel are burned in an external combustion system and the high temperature combustion products are selectively supplied through the valve-controlled inlet passages to the respective expansion cylinders of the engine, the combination with such engine of a pneumatically actuated valve means for controlling the flow of said combustion products to the expansion cylinder comprising:

a. a valve guide extending toward the inlet passage;

b. a chamber having a cylindrical bore adjacent the outer end of said valve guide;

c. a valve having a head and a stem, said stem extending through said valve guide and into said chamber and said head adapted for engagement with a valve seat associated with said inlet passage operative when actuated into and out of engagement with said valve seat to control the flow of fluid from the inlet passage into the expansion cylinder;

d. a plunger secured on the end of said valve stem and slidingly disposed in the cylindrical bore of said chamber; and e. means responsive to the position of said piston in said expansion cylinder for actuating said valve head into and out of engagement with said valve seat in accordance with the operating conditions of said engine, said means being operative to communicate the fluid pressure in said expansion cylinder to the chamber space above said plunger to cause said valve to be moved into engagement with said valve seat to close said inlet passage at piston positions below a predetermined point below top dead center and to terminate said communication whenever said piston is above said predetermined point.

6. The valve arrangement recited in claim 5 wherein said means responsive to the position of said piston is said expansion cylinder for actuating said valve includes an opening in the wall of said cylinder located a predetermined distance below the top thereof and passage means connecting said opening in the wall of said cylinder with an opening in the top of said chamber above said plunger.

7. The valve arrangement recited in claim 6 wherein said piston is operative to close the opening in the wall of said cylinder when said valve is to be opened and operative to open the opening in the wall of said cylinder when said valve is to be closed.

8. The combination recited in claim 1 wherein the force exerted on the plunger by the gases supplied from said cylinder to the chamber space above said plunger exceeds the sum of the forces exerted by the gases in the cylinder on the valve head and the force of friction in moving said valve.

9. In a reciprocating piston engine of the type including an external combustion system which is supplied with a suitable supply of air and fuel to be burned therein and wherein an inlet valve means controls the flow of the high temperature fluid from said combustion system into the expansion cylinder of said engine to effect a power stroke and a discharge valve means controls the discharge of fluid from said cylinder after the expansion thereof in said power stroke in a timed relationship as required for engine operation, the combination with said engine of an improved inlet valve arrangement comprising:

a. a chamber having a cylindrical bore adjacent said expansion cylinder;

b. an inlet valve having a head and a stem extending therefrom into said chamber;

c. a plunger carried by said valve stem and disposed in sealed working relationship in said cylindrical bore;

d. pressure producing means to effect the opening of said inlet valve by movement thereof in a direction away from said expansion cylinder, said means including the piston in said expansion cylinder as it moves toward its top dead center position in combination with the closing of the discharge valve a preselected number of degrees before the piston top dead center position, and e. means to effect the closing of said inlet valve at the desired time, said means including an opening in the wall of said expansion cylinder which is controlled between open and closed conditions by the position of said piston for communicating the pressure of the fluid in said expansion cylinder to the space in said cylindrical bore above said plunger at positions of said piston a preselected number of degrees below the top dead center position of said piston, said pressure acting on the surface area of said plunger and providing the force required to move said inlet valve to its closed position at the required time.

10. The improved inlet valve arrangement recited in claim 9 wherein means carried by said valve stem and within said chamber provides damping of the impact of the closing of said valve.

11. The improved inlet valve arrangement recited in claim 9 wherein the surface area of said plunger is sufficiently greater than that of the valve head and stem so that the downward force exerted on said plunger by the fluid from said expansion cylinder which is supplied thereto when the opening in said cylinder is not covered by said piston exceeds the sum of the upward force exerted by said fluid on the valve head and stem.

12. The combination recited in claim 1 including a projection on the top of said working piston in a location corresponding to the location of said valve head operative under certain machine operating conditions to contact said valve head and urge said valve toward the open position.

13. The combination recited in claim 5 including a projection on the top of said working piston in a location corresponding to the location of said valve head operative under certain machine operating conditions to contact said valve head and urge said valve toward the open position.

14. The combination recited in claim 9 including a projection on the top of said working piston in a location corresponding to the location of said valve head operative under certain machine operating conditions to contact said valve head and urge said valve toward the open position.

* * * * *